US006112505A

United States Patent [19]

Minarelli et al.

[11] Patent Number: 6,112,505

[45] Date of Patent: Sep. 5, 2000

[54] METHOD AND A MACHINE FOR THE MANUFACTURE OF RIGID PACKETS WITH HINGED LID

[75] Inventors: Alessandro Minarelli, Bazzano; Maurizio Righi, Zola Predosa, both of Italy

[73] Assignee: G D S.p.A., Bologna, Italy

[21] Appl. No.: 09/131,172

[22] Filed: Aug. 7, 1998

[30] Foreign Application Priority Data

Aug. 8, 1997 [IT] Italy ..... BO97A0504

[51] Int. Cl.[7] ..... B65B 11/18; B65B 19/22; B65B 49/00; B65D 85/10

[52] U.S. Cl. ..... 53/462; 53/208; 493/72; 493/353; 493/365; 493/911

[58] Field of Search ..... 53/462, 207, 208; 493/352, 353, 365, 364, 363, 370, 69, 70, 64, 72, 71, 911, 910; 83/346, 669

[56] References Cited

U.S. PATENT DOCUMENTS

| | | | |
|---|---|---|---|
| 4,487,596 | 12/1984 | Livens et al. | 493/911 X |
| 5,152,737 | 10/1992 | Wu et al. | 493/92 X |
| 5,316,811 | 5/1994 | Focke et al. | 493/911 X |
| 5,336,154 | 8/1994 | Focke et al. | 493/352 |
| 5,439,167 | 8/1995 | Focke et al. | 229/160.1 |
| 5,727,367 | 3/1998 | Cahill et al. | 53/462 |

FOREIGN PATENT DOCUMENTS

| | | |
|---|---|---|
| 4122900A1 | 1/1993 | Germany . |
| 651326 | 3/1951 | United Kingdom . |

*Primary Examiner*—James F. Coan
*Attorney, Agent, or Firm*—Pillsbury Madison & Sutro LLP

[57] ABSTRACT

Rigid packets of the type with a hinged lid are fashioned from diecut blanks presenting a central longitudinal portion flanked by two lateral portions, each consisting in a series of longitudinally disposed flaps. The method of manufacture involves directing the blanks singly and in succession between a pair of contrarotating rollers with dies shaped and positioned to engage each lateral portion; the dies are designed to modify a pair of adjoining flaps on each side, which ultimately will be bent through a right angle to form an internal layer of the relative flank face of the packet, by producing at least one bend in one flap at an end adjacent to the other flap, and forming a projection on the longer flap which in the finished packet will be breasted permanently in contact with an inner reinforcing frame.

12 Claims, 4 Drawing Sheets

METHOD AND A MACHINE FOR THE MANUFACTURE OF RIGID PACKETS WITH HINGED LID

BACKGROUND OF THE INVENTION

The present invention relates to a method for the manufacture of rigid packets with a hinged lid.

The present invention has particular advantages for the tobacco industry in the area of cigarette packets and their manufacture, the art field to which reference is made directly in the following specification albeit with no limitation in scope implied.

A cigarette packet of the rigid type with a hinged lid is fashioned conventionally from a precreased diecut blank exhibiting a central longitudinal portion, and two lateral portions each consisting in a succession of lateral longitudinal flaps; the steps of the relative manufacturing process include directing the blank along a predetermined path and into a folding unit, then pairing each blank with a relative frame internally of the folding unit and bending the blanks and frames in such a way as to turn out a succession of respective packets.

In general, each packet comprises a container of cupped appearance and a lid, likewise of cupped appearance, hingedly attached to an open top end of the container; the central portion of the relative blank comprises a succession of panels proportioned and positioned to generate front panels, end panels and rear panels of both the container and the lid. The two panels coinciding with the rear wall of the container and the rear wall of the lid are joined on either side to respective longitudinal flaps, which when bent ultimately at right angles to the corresponding panels will constitute an internal layer of a respective side wall of the packet.

Two distinct problems can arise typically during the formation of a packet from a blank as described above: the first deriving from the need for the two side wall inner flaps to be positioned correctly in relation one to another, and in particular the need to avoid overlapping contact between the adjoining edges of the two flaps on either side; the second from the need for the frame to remain positioned correctly in relation to the blank while the blank is being bent and folded.

The object of the present invention is to provide a simple and economical manufacturing method in which the two problems outlined briefly above can be overcome at one and the same time.

SUMMARY OF THE INVENTION

The stated object is realized according to the invention in a method for manufacturing rigid packets with a hinged lid fashioned from relative diecut blanks presenting a central longitudinal portion and two lateral portions, each consisting in a succession of longitudinal lateral flaps, which includes the steps of advancing the blanks along a predetermined path to a folding unit and, internally of the folding unit, associating each blank with a relative frame and bending the blanks and frames in such a way as to fashion respective packets.

In the method disclosed, the blanks are directed in succession between two mutually opposed and contrarotating incision rollers of a cutting and impressing unit located along the feed path, preceding the folding unit in a direction followed by the blanks along the selfsame path, of which the two rollers are embodied with matching profiles positioned and timed to engage each lateral portion of the blank, impinging on a respective pair of adjoining flaps which when bent to a right angle will ultimately constitute an internal layer of one flank wall of the packet, and designed to fashion at least one bend formed in one flap of the pair near an end adjacent to the remaining flap, and an inwardly directed projection formed on a first flap of the pair that is disposed permanently in contact with the relative frame of the finished packet.

The present invention also relates to a machine for the manufacture of packets with a hinged lid utilizing relative diecut blanks having a central longitudinal portion and two lateral portions, each consisting in a succession of longitudinal lateral flaps; such a machine typically comprises a folding unit internally of which each blank is associated with a relative frame and by which the blanks and frames are fashioned into respective packets, also feed means by which the blanks are directed along a predetermined path to the folding unit. The machine according to the invention also comprises a cutting and impressing unit located along the feed path, preceding the folding unit in a direction followed by the blanks along the feed path, consisting in two mutually opposed and contrarotating incision rollers embodied with matching profiles positioned and timed to engage each lateral portion of the blank, impinging on a respective pair of adjoining flaps which when bent through a right angle will ultimately constitute an internal layer of one flank wall of the packet, and designed to fashion at least one bend formed in one flap of the pair near an end lying adjacent to the remaining flap, and an inwardly directed projection formed on a first flap of the pair that is disposed permanently in contact with the frame of the finished packet.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 4:
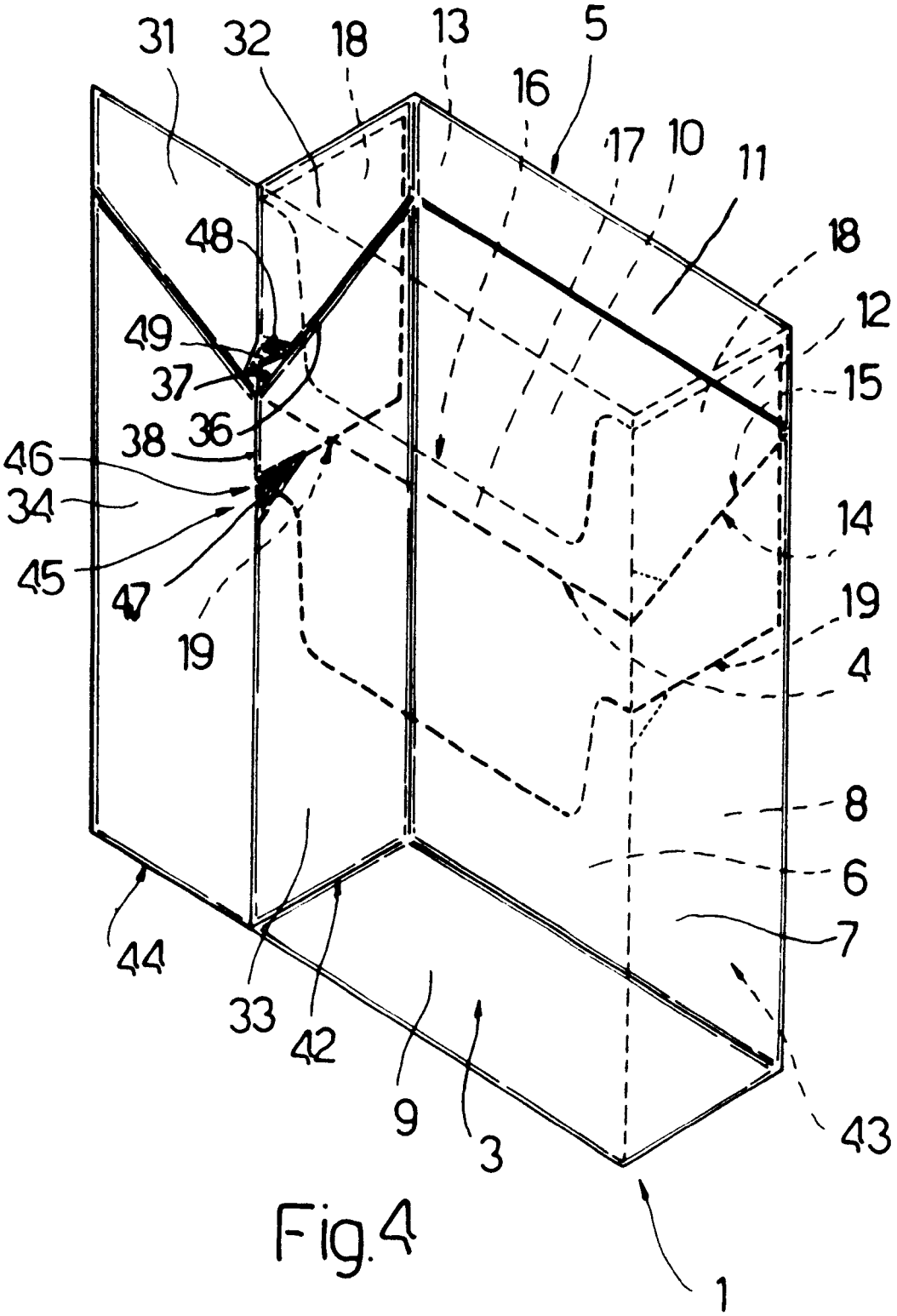
FIG. 4 is the partly exploded perspective view of a packet manufactured by a machine as in FIG. 1 and utilizing a blank as in FIG. 3.

With reference FIG. 4 of the drawings, 1 denotes a rigid packet accommodating a group of cigarettes (not illustrated) enveloped in a wrapper 2 (FIG. 1) of metal foil paper. The packet 1 presents the shape of a rectangular parallelepiped and comprises a container 3 of substantially cupped appearance with an open top end 4 and a lid 5 uppermost, also of cupped appearance, hinged to the container 3 and rotatable thus between open and closed positions in which the top end 4 is respectively exposed and concealed. The container 3 exhibits a front face 6 and a rear face 7, mutually opposed and parallel, two lateral or flank faces 8 disposed mutually parallel and perpendicular to the front and rear faces 6 and 7, and a bottom end face 9 disposed perpendicular to the remaining faces 6, 7 and 8.

In like manner the lid 5 exhibits a front face 10 and a rear face 11 mutually opposed and parallel, two flank faces 12 disposed mutually parallel and perpendicular to the front and rear faces 10 and 11 and a top end face 13 disposed perpendicular to the remaining faces 10, 11 and 12. The free edges 14 presented by the flank faces 12 of the lid 5 are offered respectively to the free edges 15 presented by the flank faces 8 of the container 3.

The packet 1 also comprises a frame 16 of U shape projecting in part from the open top end 4 of the container; the frame affords a central section 17 of which a lower portion is breasted in contact with the front face 6, and two lateral wings 18 bent at right angles in relation to the central section 17, disposed partially in contact with the corresponding flank faces 8 of the container 3 and terminating at the bottom in respective straight edges 19.

Figure 3:
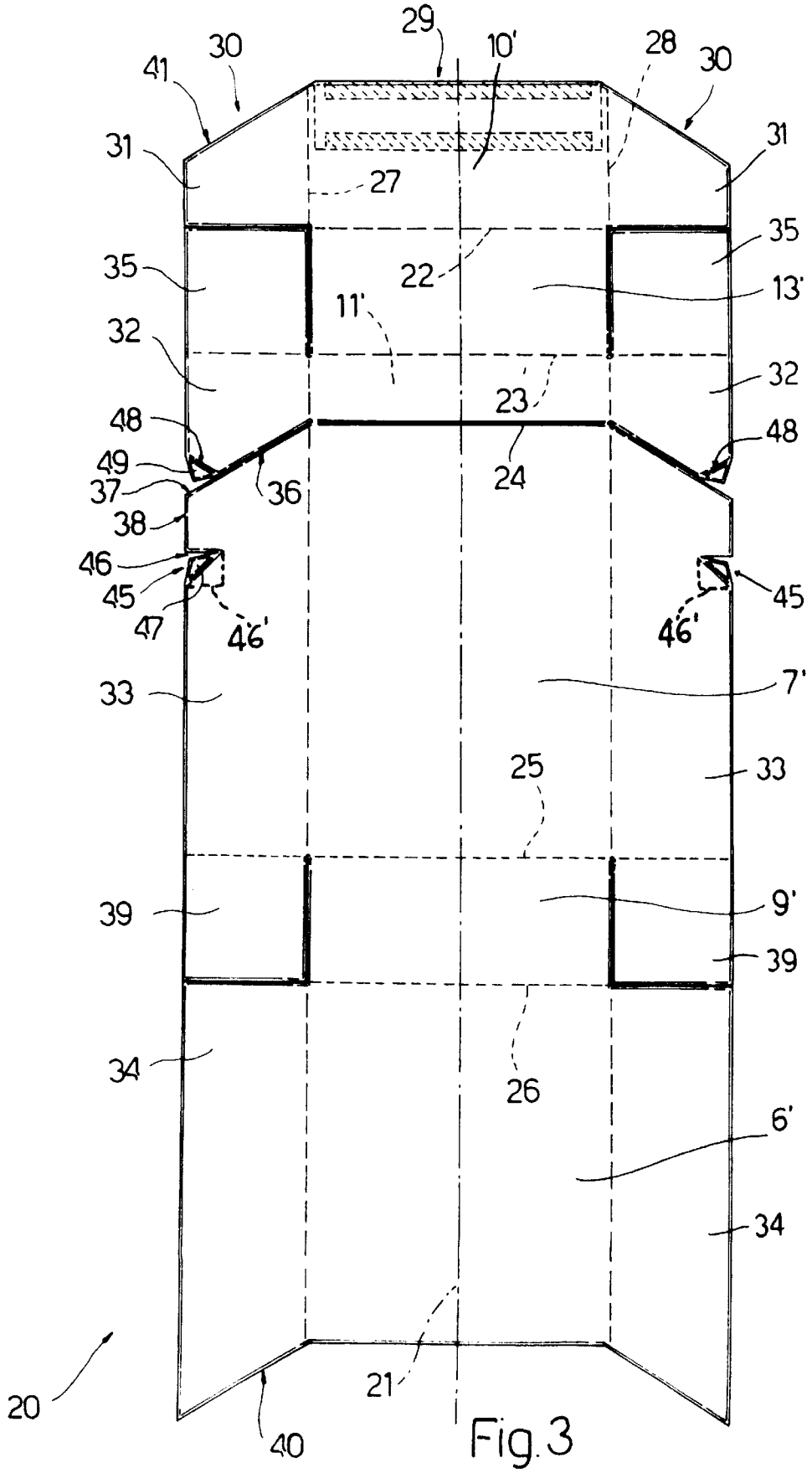
FIG. 3 is the plan view of a diecut blank from which to fashion a rigid cigarette packet.

The packet 1 described briefly above is fashioned from a flat diecut blank 20 illustrated in FIG. 3. The blank 20 has a longitudinal axis 21 of symmetry and exhibits a plurality of transverse crease lines denoted 22, 23, 24, 25 and 26, and two longitudinal crease lines denoted 27 and 28. The surface area of the blank 20 is divided by the two longitudinal crease lines 27 and 28 into a central longitudinal portion 29 and two lateral longitudinal portions 30 one on either side of the central portion 29. The transverse crease lines 22. . .28 serve to establish a plurality of panels denoted where possible by the same numbers, primed, as are used to identify the corresponding parts of the packet 1.

More exactly, the transverse crease lines 22 . . . 26 combine with the two longitudinal crease lines 27 and 28 to establish a first end panel 10' extending as far as the line denoted 22, a first intermediate panel 13' extending between the lines denoted 22 and 23, a second intermediate panel 11' extending between the lines denoted 23 and 24, also a central panel 7' extending between the lines denoted 24 and 25, a third intermediate panel 9' extending between the lines denoted 25 and 26, and finally a second end panel 6' extending from this last line 26. All of the aforementioned panels 10', 13', 11', 7', 9' and 6' are compassed within the central portion 29 of the blank.

Each lateral portion 30 comprises a respective plurality of flaps 31, 32, 33 and 34 associated externally with and separated from the respective panels 10', 11', 7' and 6' by the two longitudinal crease lines 27 and 28. The flaps 32 adjoining the first intermediate panel 11' are extended to create longitudinal appendages 35 disposed alongside the first intermediate panel 13' and united with the flaps 32 by way of the relative transverse crease line 23. The single flap 32 is of substantially trapezoidal shape 7, compassed on the side nearest the adjoining flap 33 remote from the appendage 35 by an obliquely angled edge 36 disposed parallel and adjacent to a corresponding edge 37 of this same flap 33. Each of the flaps denoted 33 likewise is substantially trapezoidal in shape, compassed externally by a longitudinal edge denoted 38 and associated at the end remote from the obliquely angled edge 37, by way of the transverse crease line denoted 25, with a longitudinal appendage 39 located alongside the third intermediate panel 9'.

The remaining flaps 34 also are trapezoidal in shape, each terminating at the end remote from the corresponding appendage 39 in an obliquely angled edge 40 disposed parallel to the edge denoted 37. The flaps 33 and 34 associated with the larger panels 7' and 6' will be bent at right angles to these same panels and overlapped by rotating the panels 6' and 7' themselves convergently through 90° each in relation to the third intermediate panel 9', so as to form the two flank faces 8 of the container 3. The free edges 15 afforded by the flank faces 8 of the container 3 are therefore generated by the mutually aligned oblique edges 37 and 40 of the two longer flaps 33 and 34. The two appendages denoted 39 will be bent at right angles to the flaps 33 from which they extend and rotated convergently, together with the two flaps 33, to the point of assuming a position flush against the inside surface of the corresponding panel 9', with which they combine to form the bottom end face 9 of the container. In like manner, the edges 41 of the flaps 31 remote from the adjoining appendages 35 are angled obliquely and parallel to the respective edges denoted 36. The four flaps 31 and 32 are bent at right angles to the corresponding panels 10' and 11' and overlapped by rotating the two panels one toward another through 900 in relation to the first intermediate panel 13', so as to form the two flank faces 12 of the lid 5. The free edges 14 afforded by the flank faces 12 of the lid 5 are therefore generated by the mutually aligned oblique edges 41 and 36 of the paired flaps 31 and 32. The relative appendages 35 are bent at 90° to the flaps 32 from which they extend and rotated convergently together with the associated flaps 32 into a position flush against the inside face of the first intermediate panel 13', with which they combine to form the top end face 13.

As readily discernible in FIG. 4, the two adjacent flaps 32 and 33 on either side will combine when bent through a right angle to provide an internal layer 42 of one respective flank wall 43 of the packet 1, whereas the remaining and corresponding flaps 31 and 34 provide an external layer 44 of the flank wall 43 when bent to a right angle; also that each longer flap 33 forms a part of the internal layer 42 that will be breasted permanently, in the finished packet 1, with the wrapper 2 and with the relative wing 18 of the frame 16,.

To the end of ensuring that the frame 16 will be positioned correctly within the container 3, each longer flap 33 of the blank 20 exhibits a relative projection 45 designed to function as a locating element for the edge 19 presented by the relative wing 18 of the frame 16. Each such projection 45 is created by making a substantially transverse cut 46 in the respective flap 33 at a given point along the longitudinal edge 38, and fashioned by bending in a portion 47 of the flap 33 located on the side of the cut 46 nearer the relative appendage 39.

In an alternative embodiment, the projections 45 in question might be created by making a first cut 46 as described above in combination with a second transverse cut 46', indicated by a phantom line in FIG. 3, made at a point in each flap 33 close to the first cut 46. In this instance the projection 45 is formed by bending in the portion compassed between the two cuts 46 and 46'.

To make certain that the two flaps 32 and 33 of each pair do not overlap even minimally during the formation of the relative layer 42, a bend is made in each of the lid flaps 32 at one end, adjacent to the obliquely angled edge 36. The bend 48 serves to create an end portion 49 on the flap 32 taking up only a part of the relative edge 36, displaced from the plane occupied the flap 32 and providing a stop against which the edge 37 of the adjacent flap 33, which occupies the same plane, is bound to locate.

It will be appreciated that the bend 48 need not appear necessarily as a single crease delimiting an end portion 49 directed away from the wrapper 2, as in the example of the drawings; in an alternative embodiment (not illustrated), there might be two creases from which to initiate a first outward bend and a second bend directed toward the inside of the packet 1. Whatever the number and orientation of the bends, in any event, the important feature is that at least one portion of the flap 32 located along a part of the obliquely angled edge 36 should be displaced from the plane occupied by the flap 32 itself.

In a further alternative embodiment, likewise not illustrated, the partial overlap between the two flaps 32 and 33 in question might be prevented by fashioning the bend 48 in the longer flap 33.

Figure 1:
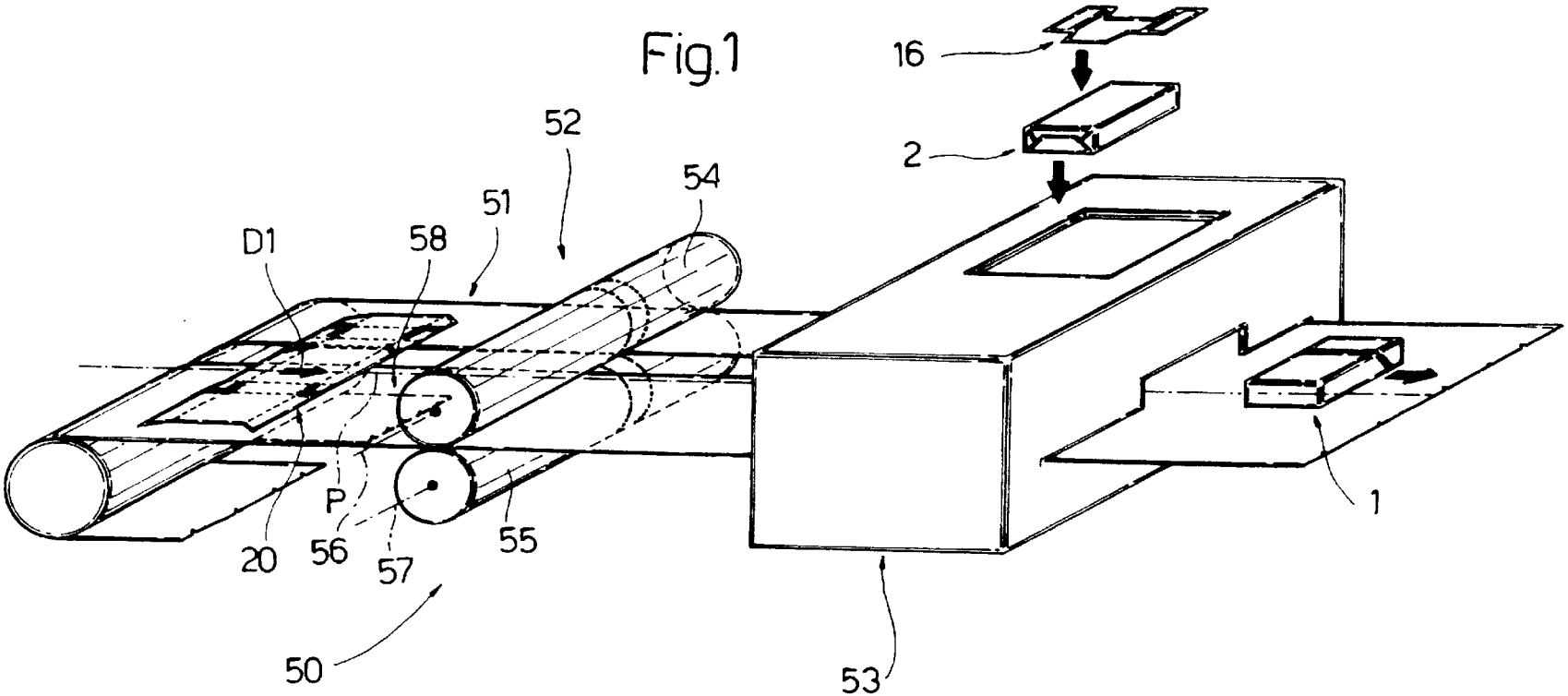
FIG. 1 illustrates a preferred embodiment of the machine according to the present invention, shown schematically in perspective and with certain parts omitted for clarity.
Figure 2:
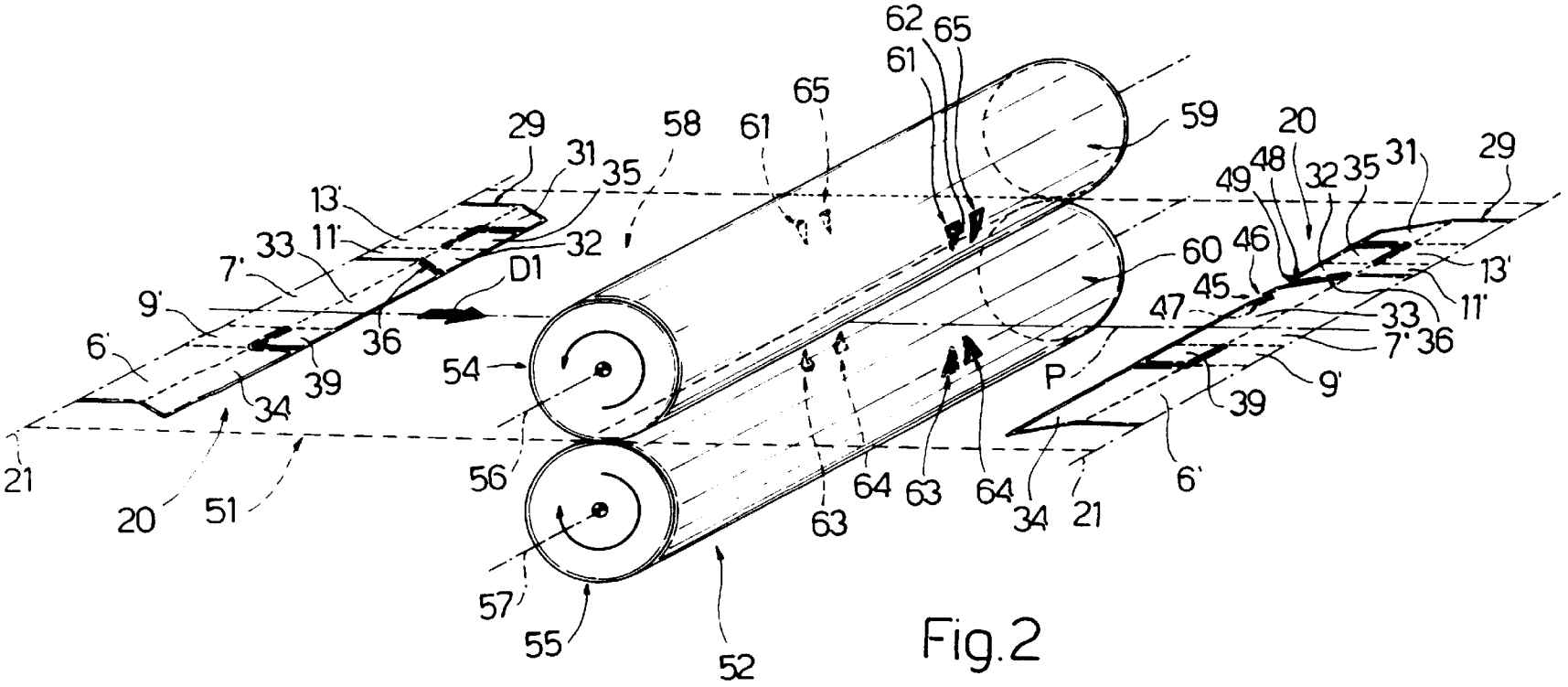
FIG. 2 is an enlarged detail of FIG. 1.

With reference to FIGS. 1 and 2, a machine 50 for the manufacture of rigid packets 1 with a hinged lid comprises a conveyor 51 by which precreased diecut blanks 20 are caused to advance singly and in succession along a predetermined direction D1, following a path P that extends through a cutting and impressing unit 52 at which the aforementioned cuts 46 and bends 48 are made in each blank 20, and a folding unit 53 located on the path P at a point following the cutting and impressing unit 52 along the feed direction D1. In the example of FIG. 1, the blanks 20 are advanced by the conveyor 51 each with its longitudinal axis 21 disposed transversely to the feed direction D1.

As illustrated to advantage in FIG. 2, the cutting and impressing unit 52 comprises two contrarotating incision rollers 54 and 55 mounted in such a way as to rotate about respective axes 56 and 57 disposed transversely to the feed direction D1, parallel one with another and with a conveying surface 58 along which the blanks 20 are advanced by the conveyor 51 each with the inside face offered to the selfsame surface 58. The two incision rollers 54 and 55 are disposed substantially tangential to one another as well as to the conveying surface 58, one above and one below, and will be power driven so as to rotate synchronously about the respective axes 56 and 57 (counterclockwise and clockwise respectively as viewed in FIG. 2) at a peripheral velocity identical to the linear velocity V at which the blanks 20 advance along the feed direction D1.

The rollers 54 and 55 are embodied with essentially cylindrical and matching outer surfaces 59 and 60. For the purpose of making the cut denoted 46, in particular, the surface 59 of the one roller 54 is furnished with two dies 61, each of which affords a lateral cutting edge 62 disposed circumferentially in relation to the roller 54, whilst the surface 60 of the remaining roller 55 affords two sockets 63 each positioned to admit a corresponding die 61. The distance separating the two dies 61, measured circumferentially in relation to the roller 54, is substantially equal to the distance between the two edges 38 (effectively the width) of the blank 20, and the radial dimensions of the rollers 54 and 55 are such that when the surfaces 59 and 60 are set in contrarotation at a peripheral velocity equal to the linear velocity V of the blanks 20, each die 61 will intercept the conveying surface 58 at the same moment as a respective edge 38 passes through the area of convergence between the rollers 54 and 55 and the surface 58, with the result that a cut 46 is made in the selfsame edge 38 and the portion 47 of the relative flap 33 is bent toward the opposite roller 55 and into the relative socket 63, thereby fashioning the projection 45.

For the purpose of making the bend denoted 48 the surface 60 of the one roller 55 is furnished with two dies 64, each disposed in substantial alignment with a relative socket 63 on a given generator of the roller 55, whereas the surface 59 of the other roller 54 affords two sockets 65 each positioned to admit a matching die 64 and disposed substantially in alignment with a relative cutting die 61 along a given generator of the roller. The two dies 64 are separated by a distance, measured circumferentially around the relative roller 55, substantially equal to the distance separating the two longitudinal edges 38 (effectively the width) of the blank 20, and the radial dimensions of the rollers 55 and 54 are such that when the surfaces 60 and 59 are set in contrarotation at a peripheral velocity equal to the linear velocity V of the blanks 20, each die 64 will intercept the conveying surface 58 at the same moment as a respective edge 38 passes through the area of convergence between the rollers 54 and 55 and the surface 58, with the result that a bend 48 is made in the relative flap 32.

In an alternative embodiment of the machine 50 (not illustrated in the drawings), the blanks 20 might be advanced by the conveyor 51 toward and between the rollers 54 and 55 each with its longitudinal axis 21 disposed parallel to the feed direction D1.

In this instance, the arrangement of the rollers 54 and 55 remains the same as described previously and illustrated in FIG. 2, whilst the surfaces 59 and 60 would be shaped differently inasmuch as the bend 48 in the one flap 32 and the cut 46 in the adjacent flap 33 will be produced in succession, rather than simultaneously, during the passage of the blank 20 through the area of tangential convergence between the rollers 54 and 55 and the conveying surface 58. Accordingly, the two dies 61 of the one roller 54 would be aligned on one and the same generator of the relative cylindrical surface 59, and the two dies 64 of the opposite roller 55 aligned likewise on a single generator of the relative cylindrical surface 60.

What is claimed:

1. A method for manufacturing rigid packets having a hinged lid fashioned from relative diecut blanks, the diecut blanks each including a central longitudinal portion and two lateral portions, each lateral portion including a plurality of longitudinal lateral flaps, the method comprising:

advancing the blanks along a predetermined path to a folding unit, the folding unit (i) associating each blank with a relative frame and (ii) bending the blanks and frames to fashion respective packets;

wherein the blanks are successively fed between two mutually opposed and contrarotating incision rollers of a cutting and impressing unit located along the path prior to the folding unit;

impinging a respective pair of adjoining flaps between the two rollers, the adjoining flaps being adapted to form an internal layer of one flank wall of the packet when bent to a right angle, the impinging forming (i) at least one bend in one flap of the pair the bend adjacent the remaining flap of the pair; and (ii) an inwardly directed projection on the remaining flap, the projection being disposed for permanent contact with the relative frame of a completed packet;

wherein the two rollers are embodied with matching profiles positioned and timed to engage each lateral portion of the blank, and thereby impinge the respective pair of adjoining flaps thereof.

2. A method as in claim 1, wherein the projection is obtained by effecting at least one cut in a longitudinal lateral edge of the relative first flap and bending a portion of the selfsame first flap away from a plane occupied by the remainder of the flap.

3. A method as in claim 2, wherein the projection is obtained by effecting two cuts in the longitudinal lateral edge of the flap and bending the portion compassed between the two cuts.

4. A method as in claim 3, wherein the bend is formed by causing at least one end portion of the relative flap to be diverted away from a plane occupied by the remainder of the flap.

5. A method as in claim 4, wherein the blanks present a predominating longitudinal axis extending parallel to the longitudinal lateral flaps, and are advanced toward the cutting and impressing unit with the longitudinal axis disposed transversely to the conveying direction.

6. A method as in claim 5, wherein the bend and the projection are produced simultaneously on each pair of longitudinal flaps.

7. A method as in claim 6, wherein the blanks are directed toward the two rollers along a conveying surface, the two rollers being disposed on opposite sides of and tangential to the conveying surface, and set in rotation thus in such a manner as to revolve at peripheral velocities identical to one another and to a linear velocity at which the blanks are caused to advance along the conveying direction.

8. A machine for manufacturing rigid packets having a hinged lid formed from relative diecut blanks having a central longitudinal portion and two lateral portions, each lateral portion including a succession of longitudinal lateral flaps, the machine comprising:

a folding unit adapted to associate each blank with a relative frame and for fashioning blanks and frames into respective packets;

feed means adapted to direct the blanks along a predetermined path to the folding unit;

a cutting and impressing unit located along the path prior to the folding unit, the cutting and impressing unit including two mutually opposed and contrarotating incision rollers embodied with matching profiles positioned and timed to engage each lateral portion of the blank, the rollers being adapted to impinge a respective pair of adjoining flaps which when bent to a right angle form an internal layer of one flank wall of the packet, the impinging forming (i) at least one bend; in one flap of the pair, the bend adjacent the remaining flap of the pair; and (ii) an inwardly directed projection on the remaining flap of the pair adapted for contacting and positioning the relative frame of a finished packet.

9. A machine as in claim 8, wherein the two mutually opposed incision rollers are embodied with matching profiles appearing on a first roller as a first cylindrical surface plus at least one first cutting and bending die extending in a substantially radial and outwardly oriented direction with respect to the first cylindrical surface, and appearing on a second roller as a second cylindrical surface plus at least one first cutting and bending socket extending in a substantially radial and inwardly oriented direction with respect to the second cylindrical surface, of which the first die is timed and positioned to engage the corresponding first socket at a point of tangential convergence between the two rollers in such a way as to fashion the projection.

10. A machine as in claim 9, wherein the matching profiles additionally comprise at least one second bending die afforded by the second roller, extending in a substantially radial and outwardly oriented direction relative to the second cylindrical surface, and at least one second bending socket afforded by the first roller, extending in a substantially radial and inwardly oriented direction relative to the first cylindrical surface, of which the positioning and timing is such that the second die will engage the corresponding second socket at a point of tangential convergence between the two rollers and fashion the bend.

11. A machine as in claim 10, wherein the first die and the second socket are aligned along one and the same straight line generator of the first roller.

12. A machine as in claim 11, wherein the first roller comprises two first dies and two second sockets, of which the first dies occupy positions on the first cylindrical surface separated one from another by a distance, measured circumferentially with respect to the selfsame first cylindrical surface, that is equal to the width of a single diecut blank.

* * * * *